United States Patent [19]

Kreth

[11] Patent Number: 4,783,377

[45] Date of Patent: Nov. 8, 1988

[54] TUNDISH LID

[75] Inventor: Hermann Kreth, Wiener Neustadt, Austria

[73] Assignee: Fa.Dipl.-Ing.Bela Tisza & Co. vormals Muhlen-Industries fur Zerkleinerung und Aufbereitung Gesellschaft mbH, Vienna, Austria

[21] Appl. No.: 26,017

[22] Filed: Apr. 2, 1979

[30] Foreign Application Priority Data

Apr. 4, 1978 [AT] Austria ..... 2371/78

[51] Int. Cl.[4] ..... B21D 39/00; C21B 7/22

[52] U.S. Cl. ..... 428/594; 266/159; 266/286; 266/158; 428/600

[58] Field of Search ..... 428/594, 600; 266/286, 266/158, 159, 283, 280

[56] References Cited

U.S. PATENT DOCUMENTS 3,233,015 2/1966 Davies et al. ..... 266/286

3,892,396 7/1975 Monaghan ..... 266/286

4,120,487 10/1978 Sjogren ..... 266/158

*Primary Examiner*—Josephine Barr

*Attorney, Agent, or Firm*—Marmorek, Guttman & Rubenstein

[57] ABSTRACT

A tundlish lid is described comprising a steel baseplate and refractory insulating layer. The refractory insulating layer has embedded in it a lattice, preferably of iron or steel, which is secured to retaining members themselves secured to one surface of the baseplate. By this means the refractory insulating layer adheres well to the baseplate. A method of making the tundlish lid is also described by positively securing the lattice in spaced relation from the surface of the baseplate by securing the lattice in slots in studs or retaining elements secured to the baseplate and then applying a layer of substantially uniform thickness of refractory insulating material over the lattice.

7 Claims, 1 Drawing Sheet

TUNDISH LID

FIELD OF INVENTION

This invention relates to a tundish lid for use in a continuous casting plant.

PRIOR ART

In the continuous casting of iron and steel, a tundish, which is diposed between a ladle and a mould, usually has a lid to prevent losses of heat and material or to prevent impurities from reaching the melt. However, conventional lids, which comprise a steel frame having an arched lining made of refractory bricks, are very complicated and expensive industrially, particularly since the lining, which is directly exposed to radiation from the melt, has to be renewed at short intervals. Similar remarks apply to a lid proposed in Austrian Patent Specification No. 315 399, which lid has a flat surface for covering an intermediate ladle, and a steel jacket lined with a thick layer of refractory material. The idea of replacing the expensive lining of refractory bricks by a less complicated heat-insulating lining was found impracticable since it is not easy to obtain an insulating layer which adheres firmly over such a wide range of temperatures (from room temperature to 1500° C. or over).

BRIEF DESCRIPTION OF THE INVENTION

According to one aspect of the present invention there is provided a tundish lid, comprising a steel baseplate, and a refractory insulating layer which is disposed on said surface and within which said lattice is embedded.

A preferred embodiment of the present tundish lid has a number of important advantages. In the case of a prior-art conventional arched or flat lining, the refractory layer is commonly 30 cm. thick and correspondingly heavy, whereas in the case of the present lid, a lining layer only about 3 to 8 cm. thick is quite adequate. A layer having high mechanical strength over the aforementioned wide temperature range can now be obtained by the incorporating in the insulating layer of a lattice which is preferably made of iron or steel.

Advantageously, in order to secure the lattice in an easy, reliable manner, retaining elements are secured to the baseplate and associated with the interstices of the lattice. Advantageously the retaining elements comprise welded-on flat studs or members made of iron and formed with slots which all face in the same direction parallel to the top surface of the baseplate, into which slots the lattice can be inserted and secured. This eliminates the need for conventional connecting elements such as screws, nuts or welds for securing a lattice as may be needed in a grinding wheel for securing a lattice anchoring the ceramic grinding material.

The lattice mat is disposed in the same manner as a reinforcement, advantageously near the surface of the refractory insulating layer, i.e. by being embedded in a region near the surface, preferably at a depth of about one third of the thickness of the finished insulating layer. As previously explained, the insulating layer can be thin compared with the baseplate, a thickness of approximately one-fifth to two-fifths of the thickness of the baseplate being sufficient. A very important result is that the refractory insulating layer need have only a third to a half the thickness of conventional linings to obtain the same insulating effect.

The refractory layer is advantageously composed of a refractory material and an inorganic binder, in particular, refractory cement or water-glass, and is in a hardened or at least substantially hardened state. If required, the layer can also contain the components of an exothermically reacting mixture and/or a flux or ignition accelerator such as cryolite.

According to another aspect of the present invention, there is provided a method of manufacturing the tundish lid according to the invention, wherein the refractory insulating layer comprises a refractory material and an inorganic binder selected from the group consisting of refractory cement and water-glass, the layer being in a substantially hardened state.

In carrying out this method, a lattice is first inserted and secured in slots or the like in retaining elements secured to the top of a baseplate made of steel, at a distance from the baseplate in dependence upon the thickness of the refractory insulating layer which is to be manufactured. Next, a uniform thickness of a material for forming the refractory insulating layer is applied over the top of the baseplate and over the lattice, compacted if necessary, and finally hardened. Advantageously the material for forming the insulating layer is first applied as a loose layer between edge strips disposed on the baseplate, the loose layer being considerably thicker than the finished product. The thickness of the layer is then reduced by ramming, shaking or similar compaction processes to the final thickness, e.g. approximately 35 mm. per 100 mm. thickness of the baseplate.

Advantageously, if the material for forming the insulating layer contains a liquid binder such as water-glass, it is desirable to use the material in a moist condition. As soon as the material has been applied to the baseplate, smoothed to the required height between the edge strips and finally compacted, the water-glass binder can be hardened with carbon dioxide. Advantageously, the treatment is carried out in a single operation, where the entire baseplate, coated with the material for forming the insulating layer, is treated with carbon dioxide in an atmosphere, of carbon dioxide, preferably under a gas-tight hood constantly supplied with carbon dioxide, until substantial or complete hardening has been obtained.

THE INSULATING LAYER

In principle, the aforementioned method of manufacturing the lining for the present tundish lid can be carried out using any material which can withstand the severe stresses arising during operation of the tundish in a continuous-casting process. If carbon dioxide is used for hardening, it is particularly advantageous to use a moist mouldable preliminary mixture having the following composition:

| | |
|---|---|
| Refractory heat-insulating material based on fire-clay and/or hollow spherical corundum: | 30–90 wt. % |
| Liquid water-glass, density approximately 1.497–1.529 g/ml. at 15° C.: | 5–15 wt. % |
| Water: | 0–15 wt. % |
| Exothermic mixture (based on aluminium, pyrolusite and/or red iron oxide): | 0–50 wt. % |
| Flux, e.g. cryolite: | 0–5 wt. % |

The water added to the preliminary mixture can be reduced in amount or omitted if the commercial concentrated grades of water-glass having a density of approximately 1.497–1.529 are replaced by more dilute solutions. If the insulating layer, besides being resistant to high temperatures and being firmly mechanically anchored to the baseplate, is also required to have an exothermic effect as soon as it comes into contact with the hot metal melt, the components of the exotherming mixture, relative to the total preliminary mixture, can comprise up to 30 wt. % aluminum powder or aluminum flakes, up to 10 wt. % pyrolusite and up to 10 wt. % red iron oxide. The ignition quality and rate of burn-off can be adjusted as desired by varying the particle size of the aluminum powder, e.g. using sprayed aluminum in granular form having a particle size of 0 to 0.5 mm, or by using aluminum foil in the form of flakes.

The following are three non-limitative examples of the composition of preliminary mixtures containing water-glass as a binder (with or without exothermic additives) or using refractory cement as a binder.

EXAMPLE 1:

| | |
|---|---|
| Fireclay 0.2–1 mm. | 64 wt. % |
| Fireclay 0–0.4 mm. | 21 wt. % |
| Liquid water-glass, density 1.497–1.529 | 6 wt. % |
| Water | 9 wt. % |

EXAMPLE 2:

| | |
|---|---|
| Fireclay 0.2–1 mm. | 47 wt. % |
| Water | 6 wt. % |
| Liquid water-glass, density 1.497–1.529 | 6 wt. % |
| Fine aluminium powder | 24 wt. % |
| Pyrolusite | 9 wt. % |
| Red iron oxide | 5 wt. % |
| Cryolite | 3 wt. % |

EXAMPLE 3:

| | |
|---|---|
| Fireclay 0–0.4 mm. | 20 wt. % |
| Fireclay 0.4–2 mm. | 16 wt. % |
| Refractory cement | 36 wt. % |
| Graphite powder | 8 wt. % |
| Water | 20 wt. % |

BRIEF DESCRIPTION OF THE DRAWINGS

In order to enable the invention to be more readily understood, reference will now be made to the accompanying drawings, which illustrate diagrammatically and by way of example, an embodiment thereof, and in which.

PREFERRED EMBODIMENT

Figure 1:
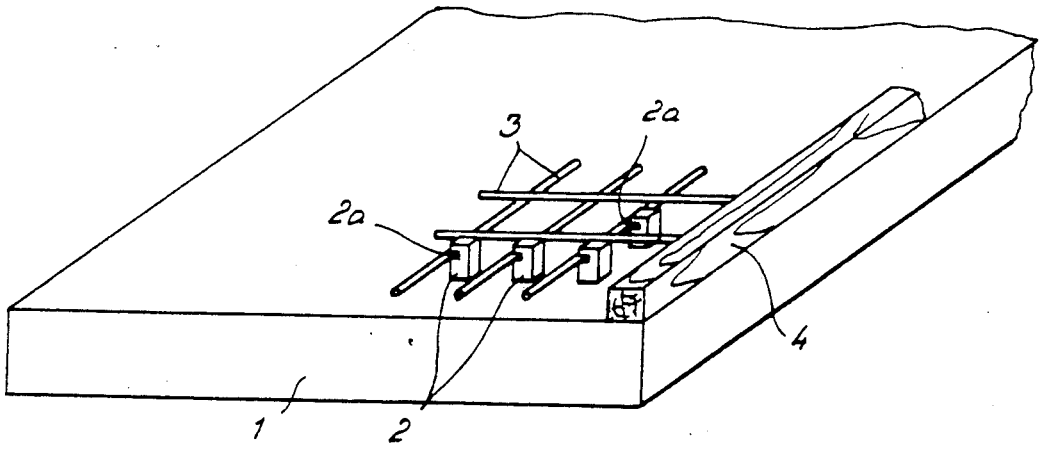
FIG. 1 is a perspective view of a tundish lid before a lattice mat has been attached thereto.

Referring now to FIG. 1, there is shown a steel baseplate 1 e.g. 100 mm. thick and having suitable dimensions for covering a tundish for a continuous casting plate. Retaining elements such as flat studs or members 2 of iron are welded on to the top of the baseplate (relative to the plate lying in a horizontal plane) and have horizontal slots 2*a*, all facing in the same direction, for receiving the rods of a spotwelded grid or lattice 3. The slotted flat members 2 are so disposed, e.g. at 120 mm. intervals in both directions, that they correspond to the pitch of the lattice 3. The lattice is inserted into the slots 2*a* by moving it parallel to the baseplate 1 and securing it in position at a distance from the baseplate.

After limit means such as wooden edge strips 4 have been secured to opposite edges or all four edges of the baseplate 1, a uniform thickness of the material for forming the refractory insulating layer is applied to the steel base plate 1, the material comprising, in the present case, sand-like particles moistened with liquid water-glass having a density of approximately 1.497 to 1.529. In the application step, the member 2 and the lattice 3 are completely covered and the thickness of the loose applied layer of insulating material is made uniform by scaping it with a plate. The material is then compacted, using a ramming tool or a shaker, to obtain a final layer e.g. 35 mm. thick.

Figure 2:
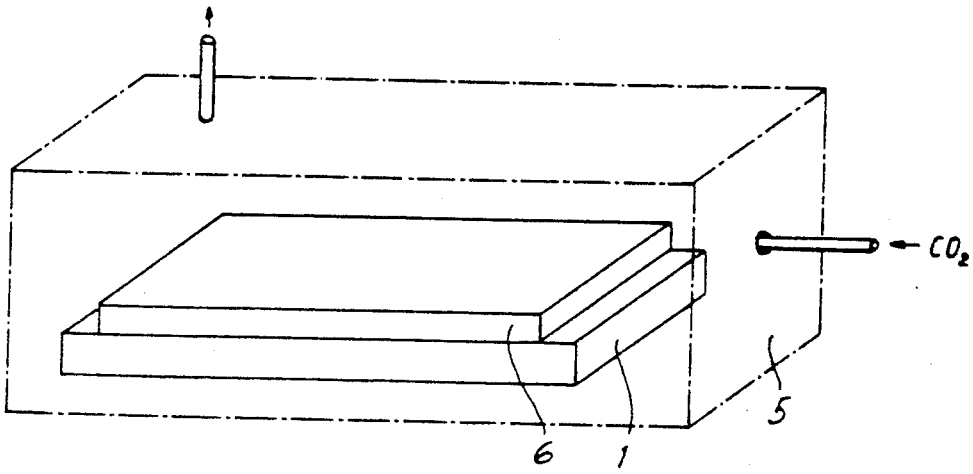
FIG. 2 shows a device for hardening the tundish lid.

Next, the edge strips 4 are removed and, as shown in FIG. 2, a gas-tight sheet steel hood 5 is inverted over the entire coated baseplate and lattice. Carbon dioxide, e.g. from a cylinder, is introduced into the space enclosed by the hood, so that the layer 6 which has been applied and which comprises a binder which can be hardened by carbon dioxide is exposed to a continuously renewed atmosphere of carbon dioxide.

After the layer 6 has thoroughly hardened, which may take 1 to 2 hours, the finished lid can be raised by a crane hook and turned and placed on a tundish. Any remaining moisture in the layer will disappear during the pre-heating of the tundish, which takes from 1 to 3 hours. Towards the end of the pre-heating (when the temperature is approximately 1000° to 1200° C.) sintering may also occur, depending upon the composition of the material, which has an important effect in increasing the final strength of the lining.

The aforementioned anchoring system of the members 2 and lattice 3 can also be used when applying cement-bonded refractory materials, which after setting, become firmly bonded to the steel plate. These refractory materials are brought to a mortar-like or plastic-like consistency by adding water in a mixer, e.g. in a concrete-mixer, and do not heed to be compacted after the layer has been applied. After 24 to 48 hours, a commercial refractory cement has set sufficiently for the resulting refractory insulating layer to be strong enough for the complete lid to be turned over and used for its intended purpose.

I claim:

1. A tundish lid, comprising a steel baseplate, a lattice positively held in spaced relation from a surface of said baseplate, and a refractory insulating layer which is disposed on said surface and within which said lattice is embedded.

2. The lid of claim 1, wherein retaining elements are secured to said surface and serve to hold the lattice in spaced relation to said surface.

3. The lid of claim 2, wherein the retaining elements are flat members of iron formed with slots facing in the same direction to receive the lattice.

4. The lid of claim 1, wherein the lattice is embedded in about the outer third of the refractory insulating layer.

5. The lid of claim 1, wherein the refractory insulating layer is from one-fifth to two-fifths of that of the baseplate.

6. The lid of claim 1, wherein the refractory insulating layer comprises a refractory material and an inorganic binder selected from the group consisting of refractory cement and water-glass, the layer being in a substantially hardened state.

7. The lid of claim 1, wherein said layer has a thickness of 35 mm. per 100 mm. of baseplate thickness.

* * * * *